United States Patent [19]

Cheng

[11] Patent Number: 4,669,286

[45] Date of Patent: Jun. 2, 1987

[54] COMBINATION CHANGING MECHANISM AND COMBINATION LOCK USED SAID MECHANISM

[76] Inventor: Ching-Yuan Cheng, 64-5, Alley 70 Lane 419, Pei Tun Rd., Taichung, Taiwan

[21] Appl. No.: 806,414

[22] Filed: Dec. 9, 1985

[51] Int. Cl.[4] ..... E05B 37/12

[52] U.S. Cl. ..... 70/312; 70/316

[58] Field of Search ..... 70/312, 71, 316

[56] References Cited

U.S. PATENT DOCUMENTS

| | | | |
|---|---|---|---|
| 3,851,507 | 12/1974 | Gehrie | 70/312 |
| 4,142,388 | 3/1979 | Phillips | 70/316 |
| 4,198,837 | 4/1980 | Gisiger | 70/316 |
| 4,249,469 | 2/1981 | Craske | 70/312 |
| 4,462,232 | 7/1984 | Yang | 70/312 |
| 4,532,784 | 4/1985 | Yeh | 70/312 |

FOREIGN PATENT DOCUMENTS

| | | | |
|---|---|---|---|
| 1076739 | 7/1967 | United Kingdom | 70/316 |
| 1135180 | 12/1968 | United Kingdom | 70/316 |

*Primary Examiner*—Henry S. Raduazo
*Attorney, Agent, or Firm*—Holman & Stern

[57] ABSTRACT

The present invention discloses a combination changing mechanism for a combination lock comprising a plurality of dial wheels rotatably mounted to the housing of the combination lock, each including a first shaft and a plurality of first teeth extending axially and arranging equidistantly on the outer surface of the first shaft; a plurality of combination changing wheels, each inlcuding a bore for receiving one of the first shaft, an elongated slot communicating with the bore and extending through one side of the combination changing wheel so that the combination changing wheel can be deformed and expanded slightly by a pushing force from one of the dial wheel acting to the peripheral wall of the bore, and a plurality of second teeth on the peripheral wall of the bore to engage with one of the first teeth of the dial wheels; and a movable element having a plurality of stop projections, and capable of being moved to make the stop projections insert respectively into the elongated slots for perventing the combination changing wheels from rotation, whereby the dial wheels can be rotated relative to the combination wheels respectively to change the engaging relationship between the dial and combination changing wheels, so that the combination changing operation is achieved.

9 Claims, 10 Drawing Figures

COMBINATION CHANGING MECHANISM AND COMBINATION LOCK USED SAID MECHANISM

BACKGROUND OF THE INVENTION

The present invention relates to a combination changing mechanism for the non-coaxial combination lock and the combination lock used said mechanism for luggage case.

As known in the prior art, the arrangement of the dial wheel of luggage case combination lock includes the coaxial and non-coaxial types. Both are consistent in principle that the engaging relaltionship between the dial wheel and the combination changing wheel can be changed to achieve the combination change.

In general, there are two ways to let their engaging relationship be changed. The first way is that the dial wheel is moved longitudinally relative to the combination changing wheel so that their inner and outer teeth are disengaged with each other, the dial wheel is then rotated a predetermined angle, and pushed toward the changing wheel to let the inner and outer teeth engage in a new relationship. The second way is that a compressible spring is arranged within a cavity in the combination changing wheel to act as an inner tooth. When the changing wheel is refrained from rotating, the rotation of the dial wheel will compress the spring inner tooth by its outer tooth so that the combination change is achieved.

It is noted from long-term use that the combination lock used either combination changing mechanism mentioned above has some drawbacks as follows: [a]. To allow the dial wheel to be moved longitudinally relative to the combination changing wheel, in the former mechanism the lock housing must provide sufficient space, resulting in the increase of the volume of the lock, and this limits the arranging range of the lock. [b]. In the latter mechanism, the mounting of the spring inner tooth increases the cost, and the spring will easily become weak and thus lose its function, resulting in incorrect operation of the combination change.

An improved combination changing mechanism according to one preferred embodiment of the present invention intends to improve on the above-described drawbacks.

SUMMARY OF THE INVENTION

The primary object of the present invention is to provide a combination changing mechanism for combination lock, which need not the relatively axial movement between the dial wheel and the combination changing wheel so that the volume of the lock housing can be significantly reduced.

Another object of the present invention is to provide a combination changing mechanism without using the compressible spring, this prevents from the incorrect operation of changing combination.

Yet another object of the present invention is to provide a combination lock used the combination changing mechanism mentioned above, which has a thin housing that can be mounted on the outer wall of a luggage case, such as suitcase or the like. The operation of changing combination can be done in the outside of the case without opening the case.

Yet another object of the present invention is to provide a combination lock used the combination changing mechanism mentioned above, which can be mounted on the corner between the front and top walls of the upper lid of the case, and which includes a viewing window having a magnifying function for the operator to clearly observe the numbers presenting on the dial wheels.

In accordance with the present invention, a combination changing mechanism for a combination lock comprising a plurality of dial wheels rotatably mounted to the housing of the combination lock, each including a first shaft and a plurality of first teeth extending axially and arranging equidistantly on the outer surface of the first shaft; a plurality of combination changing wheels, each inlcuding a bore for receiving one of the first shaft, an elongated slot communicating with the bore and extending through one side of the combination changing wheel so that the combination changing wheel can be deformed and expanded slightly by a pushing force from one of the dial wheel acting to the peripheral wall of the bore, and a plurality of second teeth on the peripheral wall of the bore to engage with one of the first teeth of the dial wheels; and a movable element having a plurality of stop projections, and capable of being moved to make the stop projections insert respectively into the elongated slots for perventing the combination changing wheels from rotation, whereby the dial wheels can be rotated relative to the combination wheels respectively to change the engaging relationship between the dial and combination changing wheels, so that the combination changing operation is achieved.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENTS

Figure 1:
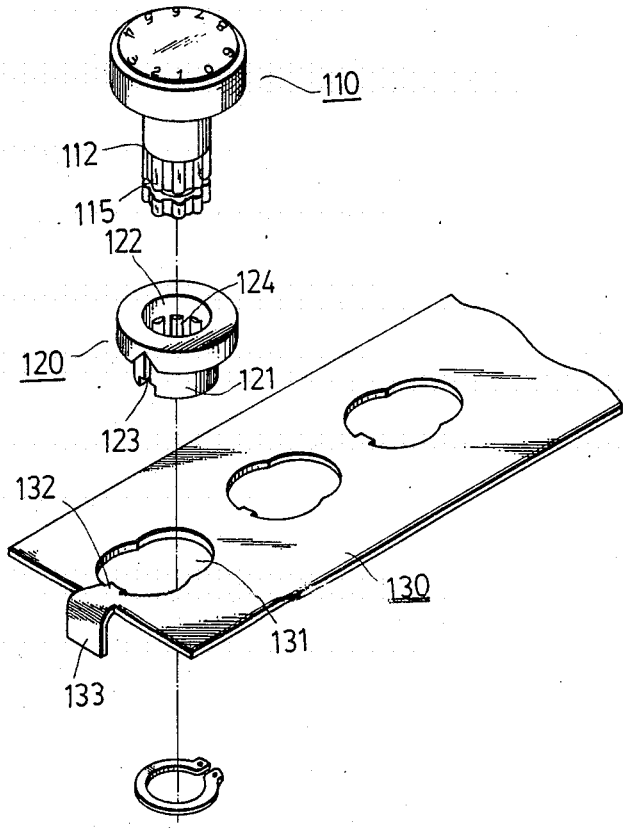
FIG. 1 is an exploded perspective view of a combination changing mechanism in accordance with one preferred embodiment of the present invention.

Referring now to FIG. 1, a dial wheel 110 includes a plurality of numerals arranging on its top and equidistantly along its circumferential periphery and a shaft 112 extending downwards a predetermined length. The lower end of the shaft 112 has an annular groove 113 to facilitate the shaft being rotatably mounted on the the lock housing by a C-clamp. The outer surface of the shaft 112 has a plurality of projecting curved teeth 115 arranging equidistantly along its circumference.

A combination changing wheel 120 formed by a plastic material of high strength includes a bore 122 to receive the shaft 112 of the dial wheel 110 and a shaft 121 having a longitudinal slot 123 which communicates with the bore 122. The wall of the bore 122 has a plurality of projecting curved teeth 124 corresponding to the teeth 115 of the dial wheel 110, so that the teeth 115 can be accommodated respectively at the positions 125 between the teeth 124.

Figure 2:
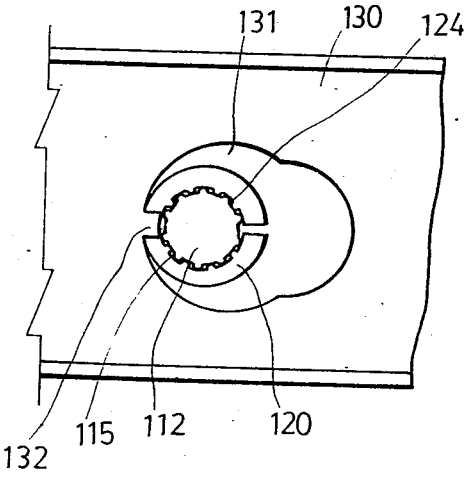
FIG. 2 is a plan view of the assembled combination changing mechanism.
Figure 2:
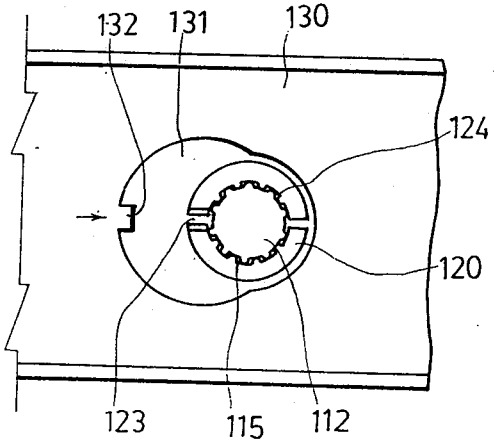

A movable element 130 includes an opening 131 formed by two round openings which have different diameters and have parts overlapped to each other. The diameter of the smaller round opening roughly equals to that of shaft 121 of the combination changing wheel 120. A stop projection 132 extends from the circumferential wall of the longer round opening. The movable element 130 also includes a lug element 133 extending downwards from its left side (viewing from FIG. 1), and is mounted so as to be moved along its longitudinal direction. When in the assembled condition, if the movable element 130 is pushed toward right direction (viewing from FIG. 1), the stop projection 132 will be inserted into the slot 123 of the combination changing wheel 120. In this case, the combination changing wheel 120 is refrained from rotation. Consequently, with reference to FIGS. 1 and 2 when the dial wheel 110 is rotated, the teeth 115 will press the teeth 124 of the changing wheel 120, resulting in the slight deformation and expansion of the bore 122 due to the expansion of the longitudinal slot 123. Therefore, the teeth 115 of the dial wheel 110 can slide over the teeth 124 of the combination changing wheel 120 so that the engaging relationship between the two wheels 110 and 120 is changed as desired, and that the combination changing function is achieve. When the combination changing wheel 120 is not refrained by the stop projection 132, the changing wheel 120 will be rotated following the rotation of the dial wheel 110 until to the release position.

Since the changing wheel 120 can be readily urged to rotate by the dial wheel 110, the teeth 115 and 124 need not be too high. In addition, since the teeth 115 and 124 are of curved shape, the combination changing operation can be readily completed. It should be noted that additional slots similar to the slot 123 of the combination changing wheel 120 can be further provided to facilitate the deformation of the bore 122.

Figure 3:
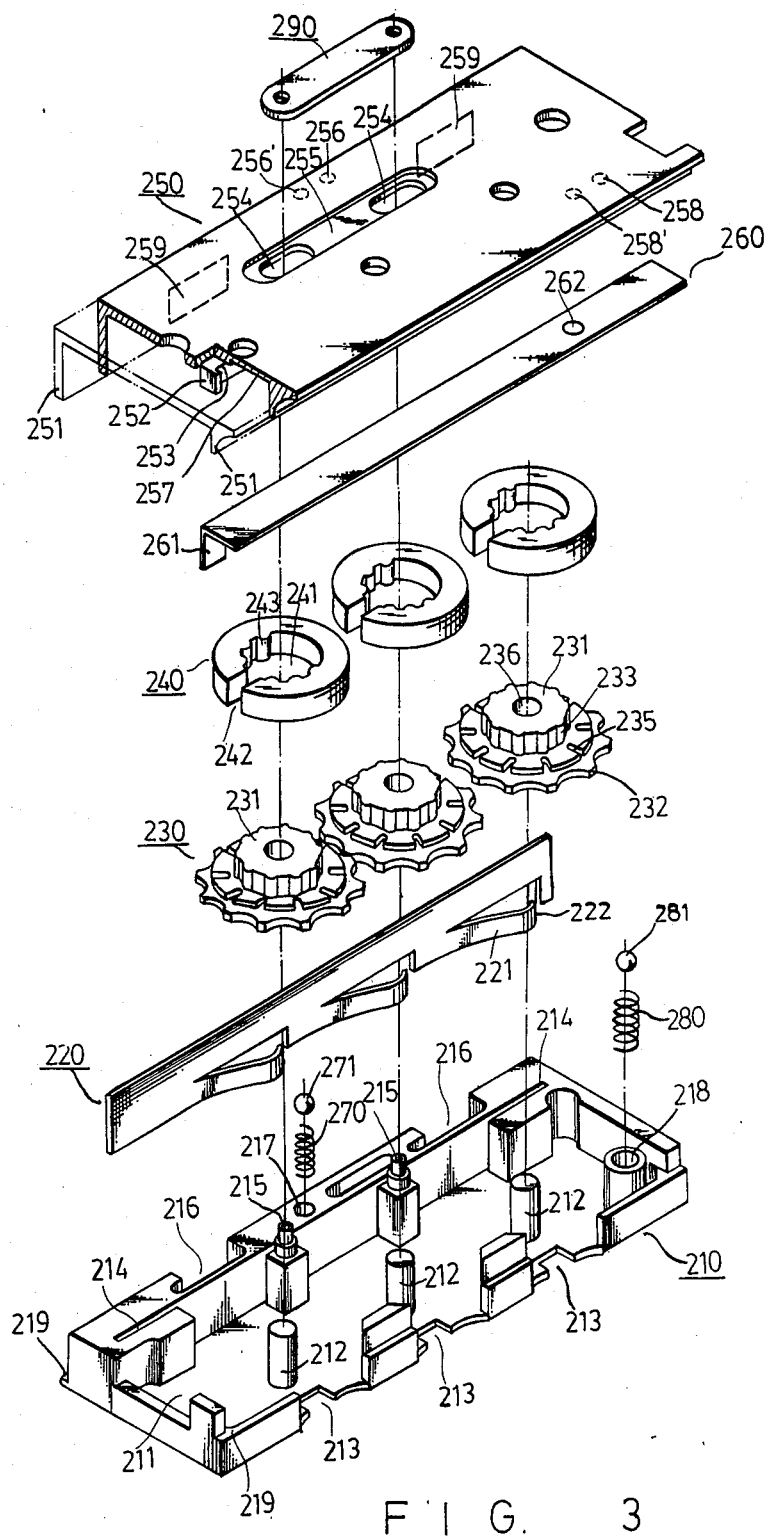
FIG. 3 is an exploded perspective view of a thin-type combination lock according to another preferred embodiment of the present invention.
Figure 4:
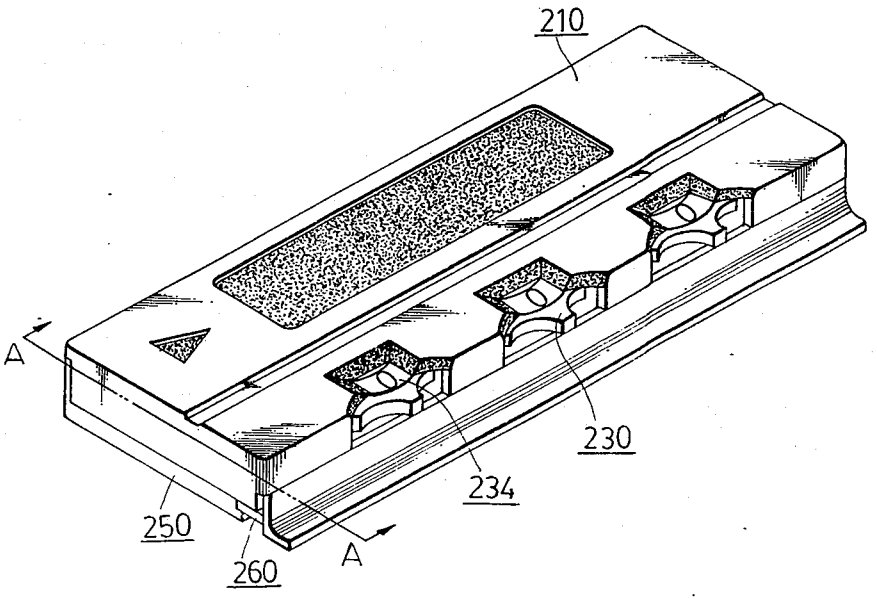
FIG. 4 is a perspective view of the assembled situation of the lock shown in FIG. 3.

In accordance with the structure of the combination changing mechanism described above, several particular types of combination lock can be obtained. Referring now to FIGS. 3 and 4, an upper housing (or "first half housing") 210 includes an elastic plate 220 secured thereon, and an accommodating chamber 211 in which three dial wheel 230 are pivotally connected respectively. It should be noted, that the combination lock shown in FIG. 3 is in an inverted position for illustrating purpose. The shaft 231 of each dial wheel 230 has been sleeved on a combination changing wheel 240. A lower housing (or "second half housing") 250 includes a sliding groove 257 to receive a movable element 260. The lower housing 250 is mounted on the upper housing 210, and can be moved relative to the upper housing 210 in longitudinal direction within a predetermined extent.

The upper housing 210 is of rectangular shape, and has the accommodating chamber 211 of predetermined deepth, which is roughly of rectangular shape. Three rods 212 extend upwards from the bottom of the chamber 211, and are separated equidistantly on a straight line. The chamber 211 includes three viewing windows 213, on which three magnifying glasses can be provided to get a clear display of the numerals, on its front side corresponding to the rods 212. The upper housing 210 also includes two fixing slots 214 and two rivets 215 on its rear side, and two hasp apertures 216 and a steel ball aperture 217, in which a spring 270 and a steel ball 271 are provided, behind the fixing slots 214. The upper housing 210 further includes a steel ball aperture 218, in which a spring 280 and a steel ball 281 are provided, on its front right corner, and two sliding tracks 219 respectively on its front and rear sides.

The elastic plate 220 is inserted in the fixing slots 214 of the upper housing 210, and includes three equidistantly separated sub-plates 221. Each sub-plate 221 bends forwards toward the chamber 211 and has a curved finger element 222 which will move rearwards upon pressing.

The dial wheels 230 may be formed by a plastic material of high strength, and each includes three stepped teeth portions, or lower, middle, and upper teeth portions 233, 235 and 232, around its circumference. The upper lower portion 233 on the shaft 231 is of curved shape in vertical cross-sectionn. The top of each dial wheel 230 has been labled a plurality of numerals 234 for recognization along its cicumference corresponding to the lower teeth portion 233. When the dial wheels 230 are sleeved onto the rods 212 of the upper housing 210 through its bore 236, the lower teeth portions 233 are exposed on the viewing windows 213, and the curved finger elements 222 of the elastic plate 220 are inserted respectively into the positions between two teeth of the upper teeth portions 232 "third teeth").

The combination changing wheel 240 may be formed by a plastic material of high strength, and is of annular shape. The changing wheel 240 includes a bore 241 for receiving the shaft 231 of the dial wheel 230, and a longitudinal slot 242 which communicates with the bore 241, so that the bore 241 can be deformed if it is pressed. The wall of the bore 241 includes a plurality of teeth 243 ("second teeth") corresponding to the lower teeth portion 233 (or "first teeth") of the dial wheel 230. It should be noted the number of the teeth 243 is less than that of the lower teeth 233 in this embodiment to facilitate the operation of the combination changing wheel 240.

The lower housing 250 is of rectangular shape corresponding to the shape of the upper housing 210, and inlcudes two skirts 251 extending respectively from its front and rear sides to be located upon the sliding tracks 219 of the uper housing 210. Three stop projections 252 are provided on the underside of the lower housing 250, each projection 252 has a recess 253 and is capable of being inserted into the slot 242 of the combination changing wheel 240. A shallow recess 255 is formed on the upper surface of the lower housing 250 to receive a pad 290, and two elongated slots 254 extend through the shallow recess 255. The rivets 215 extend through the elongated slots 254 and the pad 290 and then are fixed, so that the lower housing 250 can be moved horizontally relative to the upper housing 210 between two predetermined positions. When the lower housing 250 is in the first position, the steel ball 271 will be biased to abut the round recess 256' by the spring 270, while in the second position, the steel ball 271 will abut the round recess 256. The sliding groove 257, in which the movable element 260 is accommodated, has two apertures 258 and 258'. The rear skirt 251 has two rectangular openings 259 corresponding to the hasp apertures 216 of the upper housing 210.

The movable element 260 includes three tongues 261 capable of being inserted into the recesses of the stop projections 252, and a protrusion 262 capable of being engaged with the aperture 258 or 258'. The tongues 261 are higher than the stop projection 252, and therefore, the tongues 261 will insert respectively into the positions between two teeth of the middle teeth portions 235 if the stop projections 252 insert respectively into the slots 242 of the combination changing wheels 240. The movable element 260 can be moved individually relative to the stop projections 252, so that the tongues 261 can depart from the middle teeth portions 235 to commence the combination changing operation. The steel ball 281 is biased by the spring 280 to abut the movable element 260, so that the protrusion 262 can rest stably on the aperture 258 or 258'.

Figure 5:
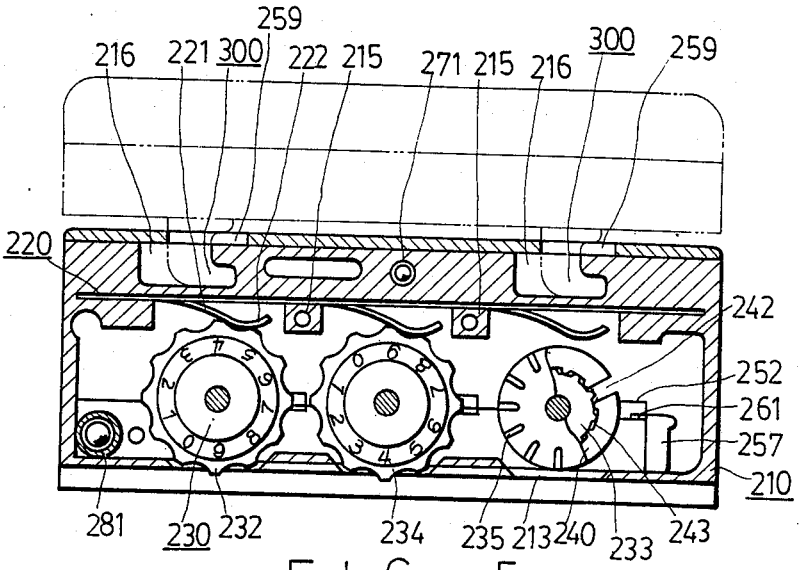
FIG. 5 is a cross sectional view of the combination lock taken along the line A–A in FIG. 4, illustrating the latching position of the lock.
Figure 6:
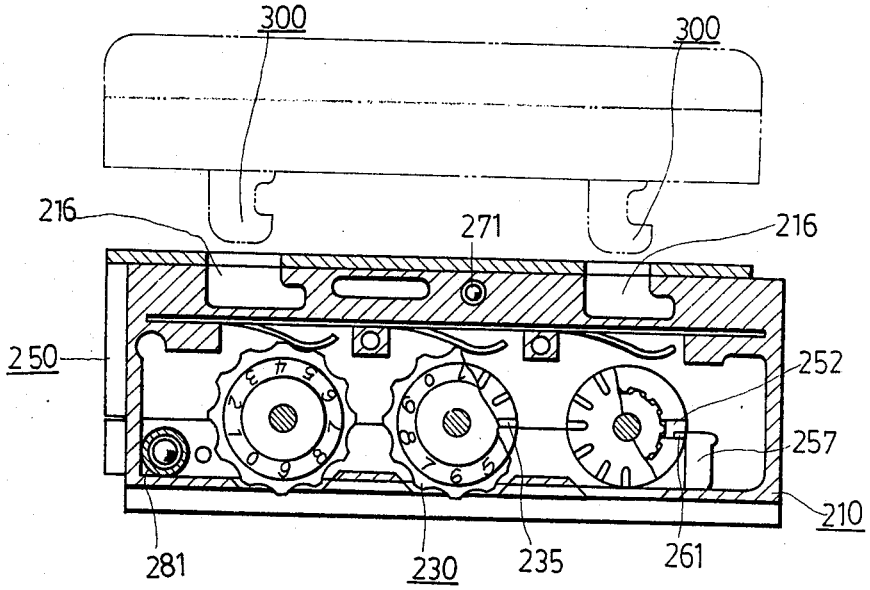
FIG. 6 is a view similar to FIG. 5, illustrating the release position of the lock.
Figure 7:
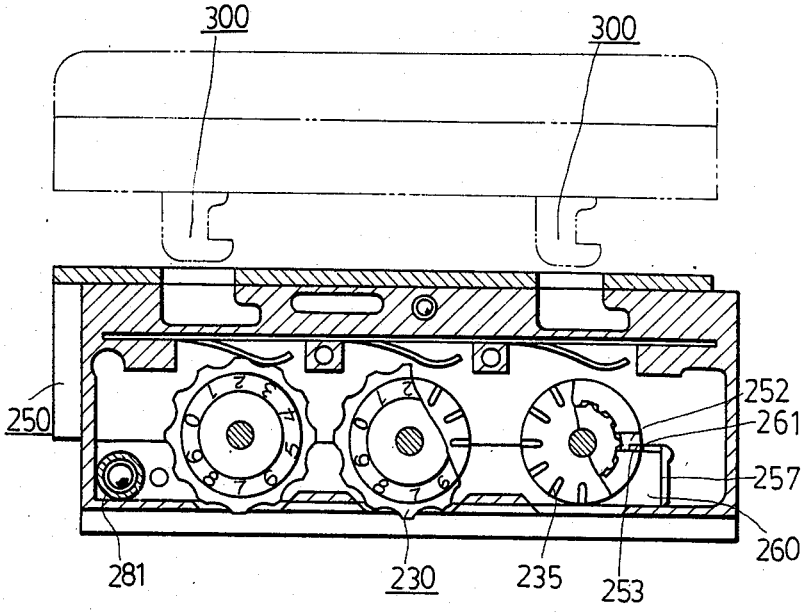
FIG. 7 is a view similar to FIG. 5, illustrating the operation of the combination changing mechanism of the present invention.

With reference to FIGS. 5 and 6, when the stop projections 252 do not face the slots 242 of the combination changing wheels 240, the upper housing 210 is refrained by the combination changing wheels 240 from movement relative to the lower housing 250, as shown in FIG. 5. Therefore, the hasps 300 are kept within the hasp apertures 216, i.e. the combination lock is in its latching positioin. When the dial wheels 230 with the combination changing wheels 240 are turned to the proper lock combination, the slots 242 of the combination wheels 240 face respectively to the stop projections 252 and the tongueS 261 of the movable element 260. In this case, the upper housing 210 can be moved a distance, resulting in that the stop projections 252 and the tongues 261 insert into the slots 242, and the tongues 261 further insert into the slots between two teeth of the middle teeth portions 235 due to its higher height, as shown in FIG. 6. Therefore, the dial and combination wheels 230 and 240 are refrained from rotation, and the combination lock is now in its release position, so that the hasps 300 can be moved away from the hasp apertures 216. The upper housing 210 can be stably located on its latching or release position because the steel ball 271 is biased by the spring 270 to firmly abut against the aperture 256 or 256'.

When one desires to change the combination, the lock must be in the release position as shown in FIG. 6. Then, the movable element 260 is pushed so as to let the tongues 261 depart from the slots 242 and the slots between the teeth of the middle teeth portions 235. In this case, the dial wheels 230 are not refrained any more, while the combination changing wheels 240 are still refrained from rotation by the stop projections 252. Therefore, the dial wheels 230 can be turned relative to the combination changing wheels 240 to the desired position to obtain a new lock combination. The movable element 260 can be stably located on its normal or combination changing position because the steel ball 281 is biased by the spring 280 to firmly abut against the movable element 260, resulting in that the protrusion 262 on the movable element 260 stably rests on the aperture 258 or 258' of the lower housing 250. When the combination changing operation is completed, the upper housing 210 is pushed to the latching position, this will urge the movable element 260 to return to its original position by the peripheries of the combination changing wheels 240 pushing the tongues 261.

Figure 9:
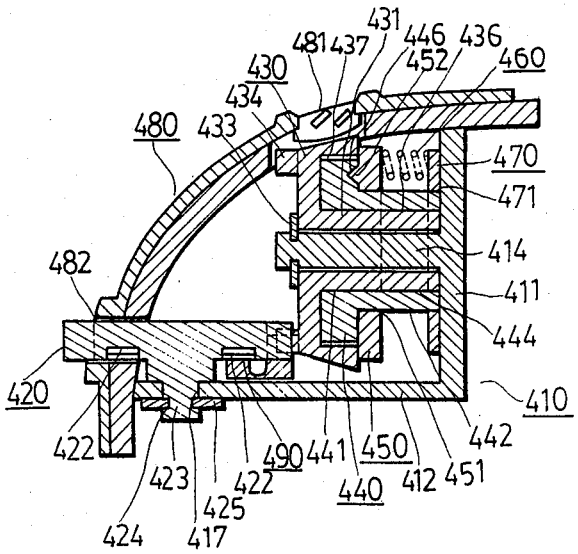
FIG. 9 is a cross sectional view of the lock of FIG. 8 taken along line Y–Y.
Figure 8:
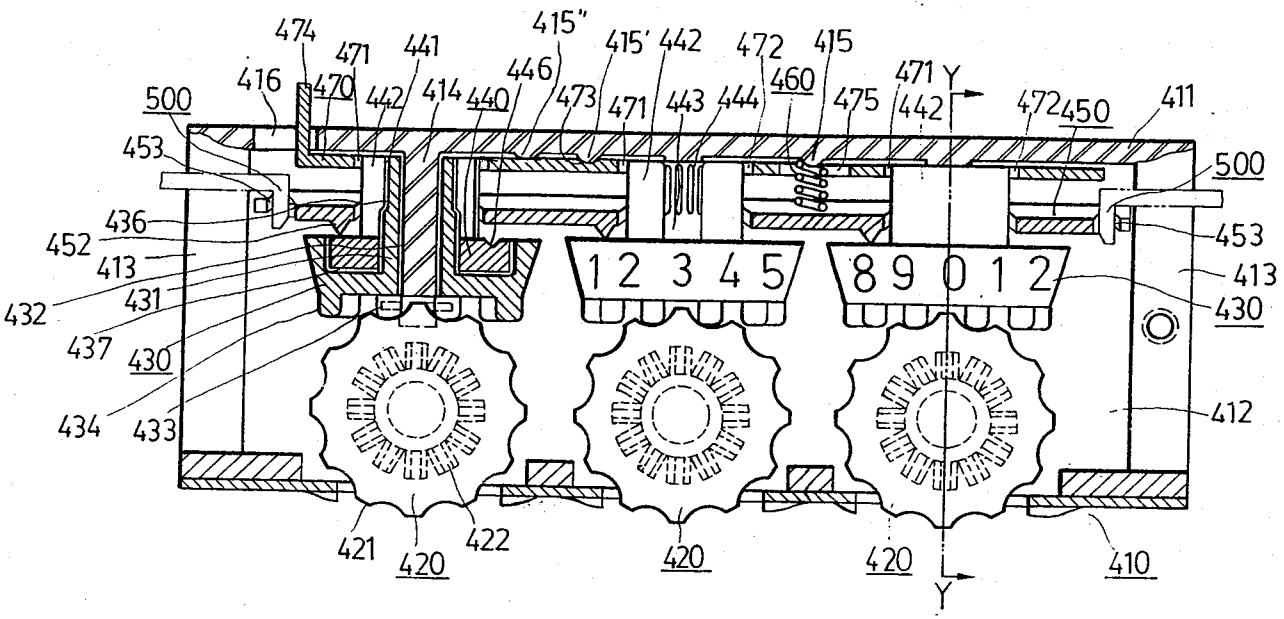
FIG. 8 is a top plan view of a combination lock according to yet another preferred embodiment of the present invention.
Figure 10:
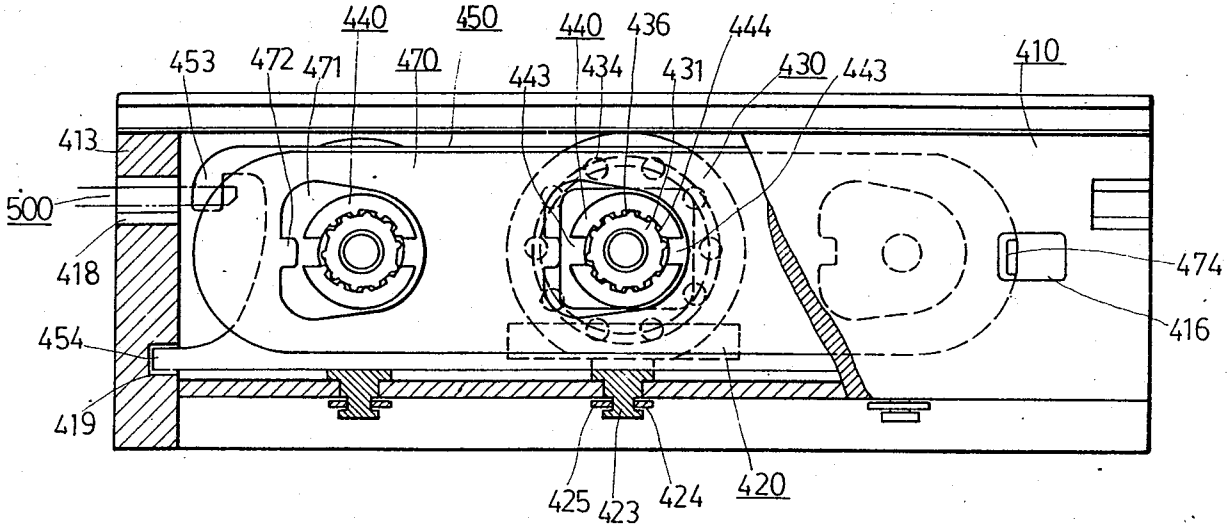
FIG. 10 is a bottom plan view of the lock of FIG. 8, with part broken away for illustrating purpose.

Referring now to FIGS. 8 to 10, there is shown a lock used the combination changing mechanism described above, which can be mounted on the junction of the front wall and the top wall of the upper lid of the luggage case, so that the display of the numurals on the dial wheels is visually clear and the operation is easier than the prior art. The combination lock includes a seat 410, three operating wheels 420, three dial wheels 430, three combination changing wheels 440, a hasp plate 450, a spring 460, a movable element 470, a lid 480, and a elastic plate 490.

The seat 410 is made up of a vertical plate 411, a horizontal plate 412, and two side plates 413. The vertical plate 411 includes three rods 414, three protrusions 415, 415', and 415'', and a rectangular opening 416 thereon. The horizontal plate 412 includes three round openings 417 corresponding to the rods 414. One side plate 413 includes a hasp aperture 418 and a groove 419.

Each operating wheel 420 includes a plurality of teeth 421 around is periphery, a plurality of radial slots 422 on its bottom, and a shaft 423 which is made up of an upper portion having a large diameter and a lower portion having a smaller diameter. The lower portion extends through the round opening 417, and an annular groove 424 is provided near the end of the lower portion for a C-clamp 425 to clamp therein, so that the operating wheel 420 is rotatably mounted on the seat 410.

Each dial wheel 430 is labeled a plurality of numerals around its periphery, and includes a shaft 431 extending downwards, and a bore 432 for the rod 414 of the seat 410 to insert therein. A C-clamp 433 is provided to clamp into a top groove of the rod 414, so that the dial wheel 430 is rotatably mounted on the seat 410. The dial wheel 430 includes a pluraliy of teeth 434 on its top surface to engage with the teeth 421 of the operating wheel 420. A plurality of curved teeth 436 extending axially on the outer surface of the shaft 431 are provided and separated equidistantly. The dial wheel 430 also includes an annular groove 437 on its bottom and around the shaft 431.

Each combination changing wheel 440 is formed by a plastic material of high strength, and includes a bore 441 to receive the shaft 431 of the dial wheel 430 so that its top portion is accommodated within the annular groove 437 of he dial wheel 430, and a shaft 442 having two longitudinal slots 443 which communicate with the bore 441. The peripheral wall of the bore 441 has a plurality of curved teeth 444 corresponding to the teeth 436 of the dial wheel 430 to engage with each other. The combination changing wheel 440 also includes a triangular groove 446 on the bottom of its top portion to control the lock to the release position.

The hasp plate 450 includes three openings 451 respectively to make the shafts 442 of the combination changing wheel 440 extend through, and three triangular protrusions 452 corresponding to the triangular grooves 446. The hasp plate 450 also includesa hasp lug 453 and a supporting bar 454 rotatably received within the groove 419 on the seat 410.

The spring 460 has one end fixed to the protrusion 415 on the seat 410, and the other end abutting against and pressing the bottom of the hasp plate 450.

The movable element 470 inlcudes three openings 471 which have irregular shape and are larger than the shafts 442 of the combination changing wheels 440 to make the shafts 442 extend through respectively. A stop projection 472 is provided on the peripheral wall of each opening 471, and is capable of being inserted into one slot 443 of one combination changing wheel 440. The movable element also includes a recess 473 for receiving the protrusion 415' or 415'', a pushing bar 474 extending through the rectangular opening 416, and an elongated slot 475 corresponding to the spring 460 so that it will not touch the spring 460 when moving.

The lid 480 is a curved plate covering the seat 410 to form an integral part. The lid 480 includes three viewing windows 481, on which three magnifying glasses are mounted to provide clearly visual display, corresponding to the dial wheels 430, and three elongated slots 482 for the teeth 421 of the operating wheels 420 to extend outwards through for easy operation by a user.

The elastic plate 490 is secured to the horizontal plate 412 of the seat 410, and has three free ends extending respectively into one radial slot 422 of each operating wheel 420 so as to produce a sound whenever the operating wheel 420 is turned a predetermined angle.

When the combination lock is in the latching position, the triangular protrusions 452 on the hasp plate 450 do not insert into the triangular slots 446 of the combination changing wheels 440 respectively. In this case, the hasp plate 450 compresses the spring 460, and the hasp lug 453 engages with the hasp 500. When one wishes to release the lock, he can rotate the operating wheels 420 by pushing the teeth 421 respectively on the wheels 420, so that the rotation of the wheels 420 will be transmitted to the dial wheels 430 and the combination changing wheels 440 through the teeth 421 and 434. Until the dial wheels 430 are turned to the proper lock combination, the triangular slots 446 face respectively to the triangular protrusions 452 of the hasp plate 450. Therefore, the triangular protrusions 452 are pushed to insert respectively into the triangular slots 446 by the spring 460 biasing the hasp plate 450 to rotate an angle about the supporting bar 454, this results in that the hasp lug 453 departs from the hasp 500. In this case, he can push the hasp 500 away from the lock to open the luggage case.

When one wishes to change the lock combination, he can push the pushing bar 474 of the movable element 470 to make the stop projections 472 insert respectively into the longitudinal slots 443 of the combination changing wheels 440 if the lock is in the release position. In this case, the stop projections of the movable element 470 can be stably kept at their combination changing position because the protrusion 415'' of the seat 410 firmly rests on the recess 473 of the movable element 470 now. When the operating wheels 420 are turned, the dial wheels 430 are rotated relative to the combination changing wheels 440 respectively because the combination changing wheels 440 are refrained from rotation by the stop projections 472. Therefore, the proper combination changing operation is achieved by the manner as described above.

In accordance with the structure of the combination lock, when one pushes the operating wheels 420, his fingers will not cover the viewing windows 481 from view. In addition, since the combination lock may be mounted on the junction of the front wall and the top wall of the upper lid of the luggage case, the operation of the lock will not be affected by the grip of the case.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modifications and equivalent structures.

What is claimed is:

1. A combination lock comprising:

a first half housing having an accommodating chamber, a plurality of rods extending outwards from the bottom of said accommodating chamber, and a plurality of viewing windows;

a plurality of dial wheels rotatably mounted respectively to said rods with parts exposed to said viewing windows, each dial wheel including a first shaft and a plurality of first teeth extending axially and arranging equidistantly on the outer surface of said first shaft;

a plurality of combination changing wheels rotatably engaged with said dial wheels respectively, each combination changing wheel including a bore for receiving one of said first shaft, an elongated slot communicating with said bore and extending through one side of said combination changing wheel so that said combination changing wheel can be deformed and expanded slightly by a pushing force from one of said dial wheel acting to the peripheral wall of said bore, and a plurality of second teeth on the peripheral wall of said bore to engage with said first teeth of one of said dial wheels;

a plurality of elastic plates mounted within said accommodating chamber of the said first half housing respectively, each dial wheel having a set of third teeth adjacent to the first teeth, each elastic plate having a free end to insert into a recess between two of said third teeth to control said dial wheels to rest at selected fixed positions; and a second half housing movably mounted to said first half housing for movement between a latching position and a release position, said second half housing including a plurality of stop projections thereon for inserting respectively into said elongated slots of said combination changing wheels to prevent said combination changing wheels from rotation when said first half housing is moved to said release position if said dial wheels with said combination changing wheels are turned to the proper lock combination, whereby said dial wheels can be rotated relative to said combination changing wheels to change the engaging relationship between said dial wheels and combination changing wheels, so that the combination changing operation is achieved.

2. A combination lock as defined in claim 1, wherein each dial wheel further includes a plurality of radial slots around its wheel periphery, and said combination lock further comprises a movable element movably mounted on said second half housing, and including a plurality of tongues for inserting respectively into one of said radial slots of one of said dial wheels to prevent said dial wheels from rotation when said first half housing is moved to said release position, said movable element being capable of being moved relative to said seond half housing to make said tongues depart from said radial slots, whereby said dial wheels can be rotated to operate the combination changing operation.

3. A combination lock as defined in claim 2, wherein said first half housing further includes a mounting groove, and metal plate mounted to said mounting groove, and the other ends of said elastic plates opposite to said free ends are secured to said metal plate.

4. A combination lock as defined in claim 3, wherein said free end of each elastic plate is formed a curved shape for facilitating stepped rotation of said dial wheels.

5. A combination lock as defined in claim 4, wherein said first half housing includes two sliding tracks on two sides and a plurality of rivets extending outwards from the bottom of said accommodating chamber, and said second half housing includes two skirts on two sides corresponding to said sliding tracks for facilitating the movement between the first and second half housings, and a plurality of elongated openings extending therethrough for said rivets to extend through and be fastened through a pad by a punch process or the like, so that said first half housing is movably secured to a second half housing.

6. A combination lock as defined in claim 5, wherein said second half housing further includes a shallow recess around said elongated openings to receive said pad therein.

7. A combination lock as defined in claim 6, wherein said first half housing further includes a first compression spring received within said accommodating chamber and a first ball element abutting against one end of said first compression spring, and said second half housing further includes two separated first recesses thereon for engaging with said first ball element dependent upon said first half housing in the latching or release position.

8. A combination lock as defined in claim 7, wherein said first half housing further includes a second compression spring received within said accommodating chamber and a second ball element abutting against one end of said second compression spring and biased by said second compression spring to abut against one side of said movable element, said movable element further includes a protrusion on the other side thereof, and said second half housing further includes two separated second recesses thereon for engaging with said protrusion dependent upon said movable element in the normal or combination changing position.

9. A combination lock as defined in claim 8, wherein each stop projection on said second half housing includes a third recess for receiving one of said tongues of said movable element.

* * * * *